US009622607B2

(12) United States Patent
Trusiak et al.

(10) Patent No.: US 9,622,607 B2
(45) Date of Patent: Apr. 18, 2017

(54) MULTIPLE GARMENT AND SPORTING GEAR HANGER

(71) Applicants: Marcey Lynn Trusiak, Wheaton, IL (US); Peter Anthony Trusiak, Wheaton, IL (US)

(72) Inventors: Marcey Lynn Trusiak, Wheaton, IL (US); Peter Anthony Trusiak, Wheaton, IL (US)

(73) Assignee: Hang Your Gear, LLC, Wheaton, IL (US)

( * ) Notice: Subject to any disclaimer, the term of this patent is extended or adjusted under 35 U.S.C. 154(b) by 0 days.

(21) Appl. No.: 14/253,652

(22) Filed: Apr. 15, 2014

(65) Prior Publication Data

US 2015/0060501 A1 Mar. 5, 2015

Related U.S. Application Data

(60) Provisional application No. 61/871,399, filed on Aug. 29, 2013, provisional application No. 61/953,578, filed on Mar. 14, 2014.

(51) Int. Cl.
*A41D 27/22* (2006.01)
*A47G 25/48* (2006.01)

(52) U.S. Cl.
CPC ..... *A47G 25/485* (2013.01)

(58) Field of Classification Search
CPC ..... A47G 25/14; A47G 25/18; A47G 25/48; A47G 25/483; A47G 25/485; A47G 25/486
See application file for complete search history.

(56) References Cited

U.S. PATENT DOCUMENTS

| | | | | | |
|---|---|---|---|---|---|
| 1,422,782 | A | * | 7/1922 | Rattan | 223/89 |
| D82,948 | S | * | 12/1930 | Livingston | D6/318 |
| 1,991,987 | A | * | 2/1935 | Smith | 223/91 |
| 2,240,885 | A | * | 5/1941 | Crocker | A47G 25/28 223/92 |
| 2,298,491 | A | | 10/1942 | Lamar | |
| 2,454,944 | A | | 11/1948 | Reynolds | |
| 2,544,886 | A | | 3/1951 | Kuhn | |
| 2,723,064 | A | * | 11/1955 | Richards | 223/93 |
| 4,046,293 | A | * | 9/1977 | Garrison | A47G 25/36 223/88 |
| 4,157,776 | A | * | 6/1979 | Dolan | A47G 25/36 223/92 |
| 4,778,088 | A | | 10/1988 | Miller | |
| 5,377,849 | A | | 1/1995 | Marin | |
| 5,584,455 | A | * | 12/1996 | Artemi | A47G 25/1442 211/113 |
| D394,926 | S | | 6/1998 | Lindsay | |
| 5,806,728 | A | * | 9/1998 | Forsstrom et al. | 223/91 |
| 5,967,388 | A | | 10/1999 | Kolton et al. | |
| 5,975,384 | A | * | 11/1999 | Manabat | 223/91 |

(Continued)

*Primary Examiner* — Nathan Durham
(74) *Attorney, Agent, or Firm* — Erickson Law Group, PC

(57) ABSTRACT

A hanger for hanging multiple garment or sports gear pieces. The hanger includes a horizontal member, a hanging hook for supporting the horizontal member on external structure, such as on a closet bar, and plural spaced-apart vertical members. Each vertical member is engaged to the horizontal member at an upper end, and each vertical member has a fastener at a lower end thereof for engaging a piece. The vertical members can be adjustable in length.

16 Claims, 7 Drawing Sheets

(56) References Cited

U.S. PATENT DOCUMENTS

| | | | | |
|---|---|---|---|---|
| 6,000,588 | A | 12/1999 | Kolton et al. | |
| 6,076,714 | A | 6/2000 | Wyenn | |
| 6,758,378 | B2 | 7/2004 | Carmichael | |
| D607,215 | S | 1/2010 | Mangano | |
| 8,181,775 | B2 | 5/2012 | Bunn | |
| 8,985,408 | B2 * | 3/2015 | Lloyd et al. | 223/91 |
| 2003/0019892 | A1 * | 1/2003 | Giampavolo | 223/87 |
| 2010/0122961 | A1 | 5/2010 | Moreau | |
| 2013/0133160 | A1 * | 5/2013 | Lloyd et al. | 24/303 |
| 2014/0034689 | A1 * | 2/2014 | Moradzadeh et al. | 223/85 |
| 2015/0014373 | A1 * | 1/2015 | Wienckoski et al. | 223/85 |

* cited by examiner

MULTIPLE GARMENT AND SPORTING GEAR HANGER

This application claims the benefit of U.S. Provisional Application No. 61/871,399 filed Aug. 29, 2013 and U.S. Provisional Application No. 61/953,578 filed Mar. 14, 2014.

TECHNICAL FIELD

The invention relates to a compact and portable device for vertical inline hanging storage of garments and protective sports gear.

BACKGROUND

Participants in active sports such as hockey and football wear garments and protective gear. After participating in the sport, the garments and gear can become dirty and wet from the player's perspiration. Heretofore, some players place the garments and gear into a bag or into a pile within a locker. The garments and gear thus contained can produce mildew and foul odors. A solution to this problem is the proper air drying of the garments and gear between uses before proper washing and drying.

U.S. Pat. Nos. 2,298,491; 2,544,886 and 6,076,714; and US published patent application US2010 0122961 describe hanging storage devices for sports apparel and gear which would allow for some air drying.

The present inventors have recognized the drawbacks of prior art devices in that prior art devices do not utilize adjustable vertical members or allow garments/gear to hang in a manner which replicates the orientation of the garments/protective gear as they are worn on the human body.

The present inventors have recognized the desirability of providing a multiple garment and sports gear hanger that is an improvement to the prior art devices and is easy to use while providing an economical use of vertical storage space and optimizing air circulation around garments and/or protective gear.

SUMMARY

An exemplary embodiment of the invention provides a hanger for hanging multiple pieces that includes a horizontal member, a hanging hook for supporting the horizontal member on external structure, such as on a horizontal closet bar, plural spaced-apart vertical members, each vertical member being engaged to the horizontal member at an upper end thereof. Each vertical member has a fastener at a lower end thereof for engaging a piece. The vertical members can be adjustable in length.

The hanging hook can extend upward from the center of the top of the horizontal member and a plurality of horizontal apertures present in the horizontal member allow for the attachment of the vertical members to which the fasteners manually attach to the edges of garments, protective gear, and the like. The length of the vertical members can be manually adjusted to allow for custom placement of the garment/protective gear items in the vertical plane.

Hanging garments/protective gear in the same orientation as they are worn on the human body optimizes storage space while maximizing air circulation. The adjustability of the vertical members better accommodates garments/protective gear of many different sizes and styles.

The exemplary embodiment of the invention would be used by persons whom participate in sports and hobbies that require protective gear.

The exemplary embodiment of the invention fits garments and gear that is sized from youth to adult. The portability of the exemplary embodiment of the invention allows users to adequately air-dry and store their gear between athletic events both at home and while traveling.

The exemplary embodiment of the invention provides a compact and portable device that provides for in-line hanging storage of garments, protective gear, padding, accessories, and uniforms such as would fit the human body. The hanger horizontal member can be angled slightly downward to the left and right sides from a center point. The hanging hook can extend upward from the apex of the horizontal member. Slots or apertures are routed through the horizontal member and at spaced-apart intervals. Straps are fed through the slots and effectively attached to the horizontal member by a snap, button, hook and loop, adhesive or sewing connection to itself. A strap adjuster is used to enable appropriate lengthening and shortening of the strap to provide for proper hanging of different sizes and shapes of equipment and accessories at custom distances from other garment pieces and/or equipment. A spring clip is at the bottom of each strap and manually attaches to the edges of the garment, protective gear, padding, uniform pieces and/or accessories. The primary horizontal member allows for the hanging of an upper body garment, chest protector, shoulder pad, and/or jersey while the clips at the end of the adjustable straps accommodate lower body garments, arm/elbow pads, pants, shin/leg padding, gloves, and accessories.

An alternate embodiment provides that the straps are length adjusted by being wound onto spools held by the primary horizontal member and the straps drawn out to a selected length downward. The selected length can be locked by a manual actuator or by manipulation of the belt. The spool can be spring loaded to automatically wind up the belt within the spool.

Numerous other advantages and features of the present invention will become readily apparent from the following detailed description of the invention and the embodiments thereof, from the claims and from the accompanying drawings.

DETAILED DESCRIPTION

Figure 1:
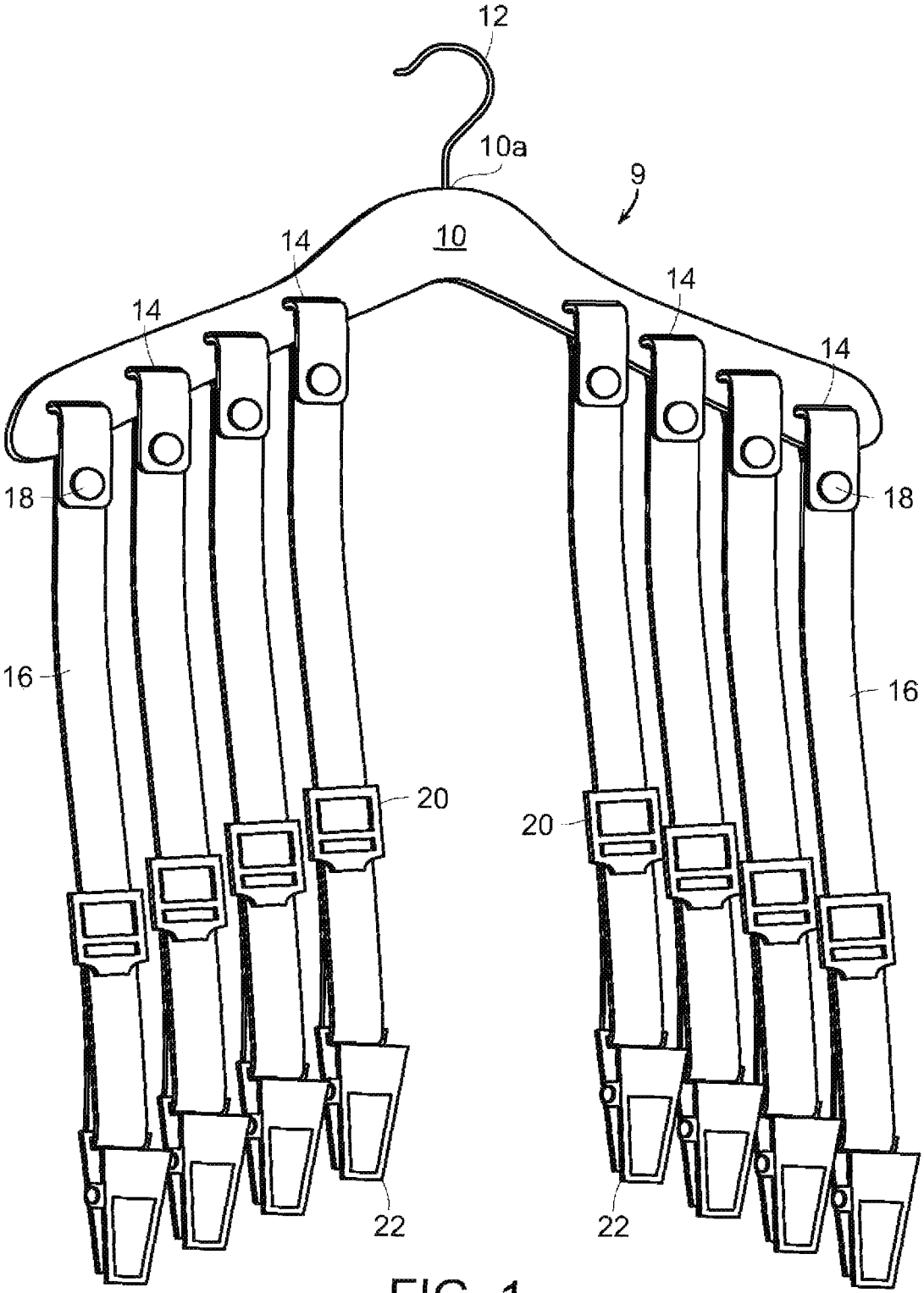
FIG. 1 is an elevation view of one embodiment hanger of the invention.
Figure 2:
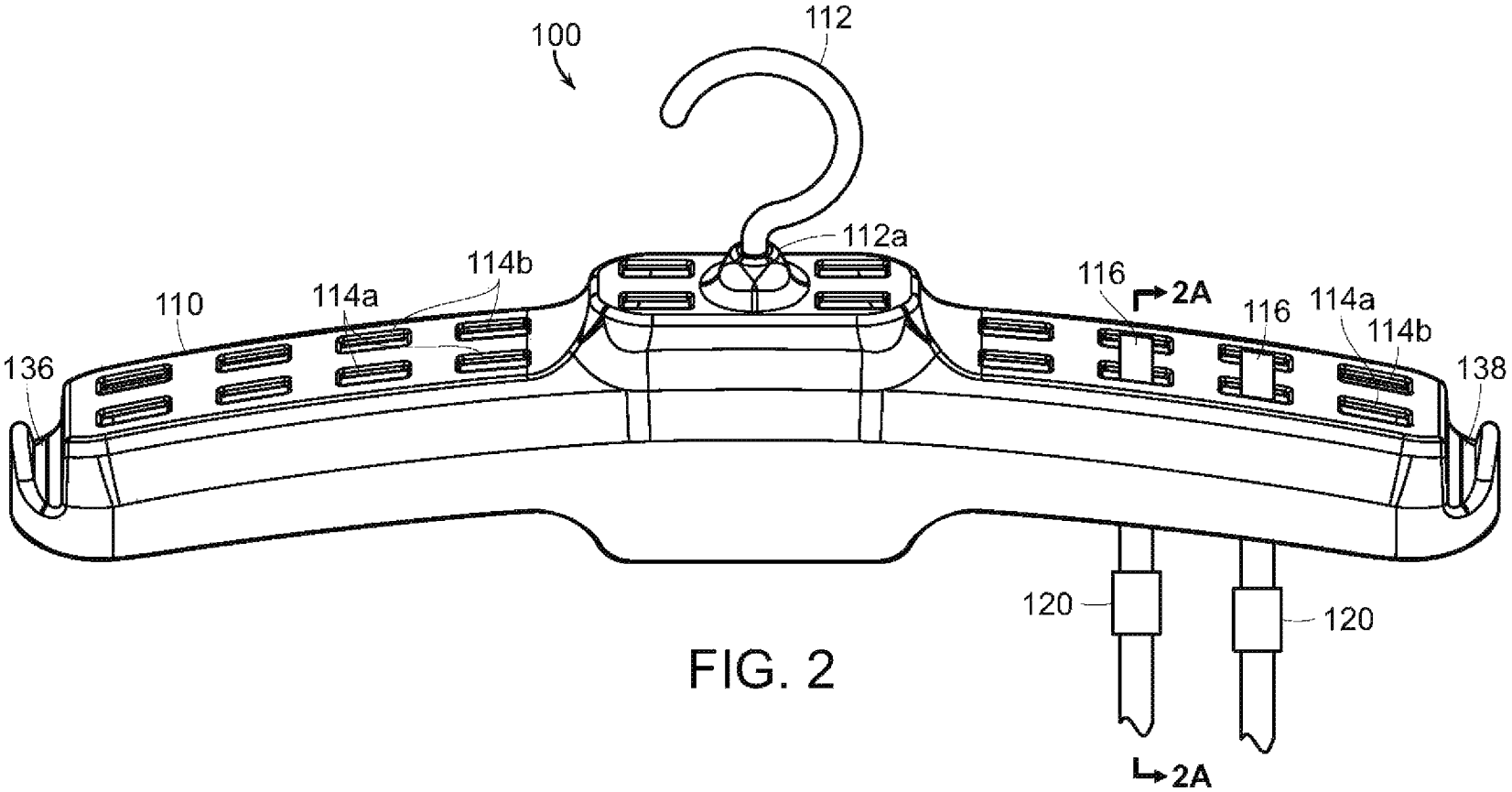
FIG. 2 is a perspective view of an alternate embodiment hanger of the invention.
Figure 2A:
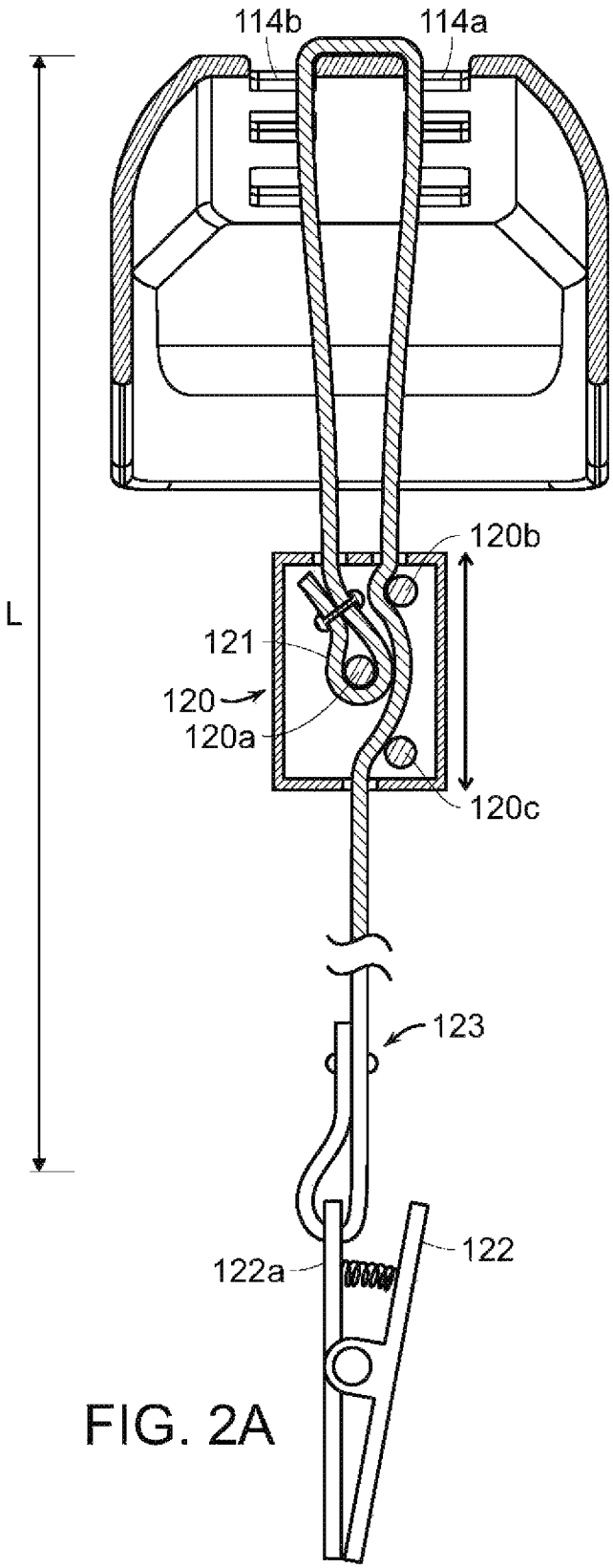
FIG. 2A is a sectional view, partly schematic, taken generally along line 2A-2A of FIG. 2.
Figure 3:
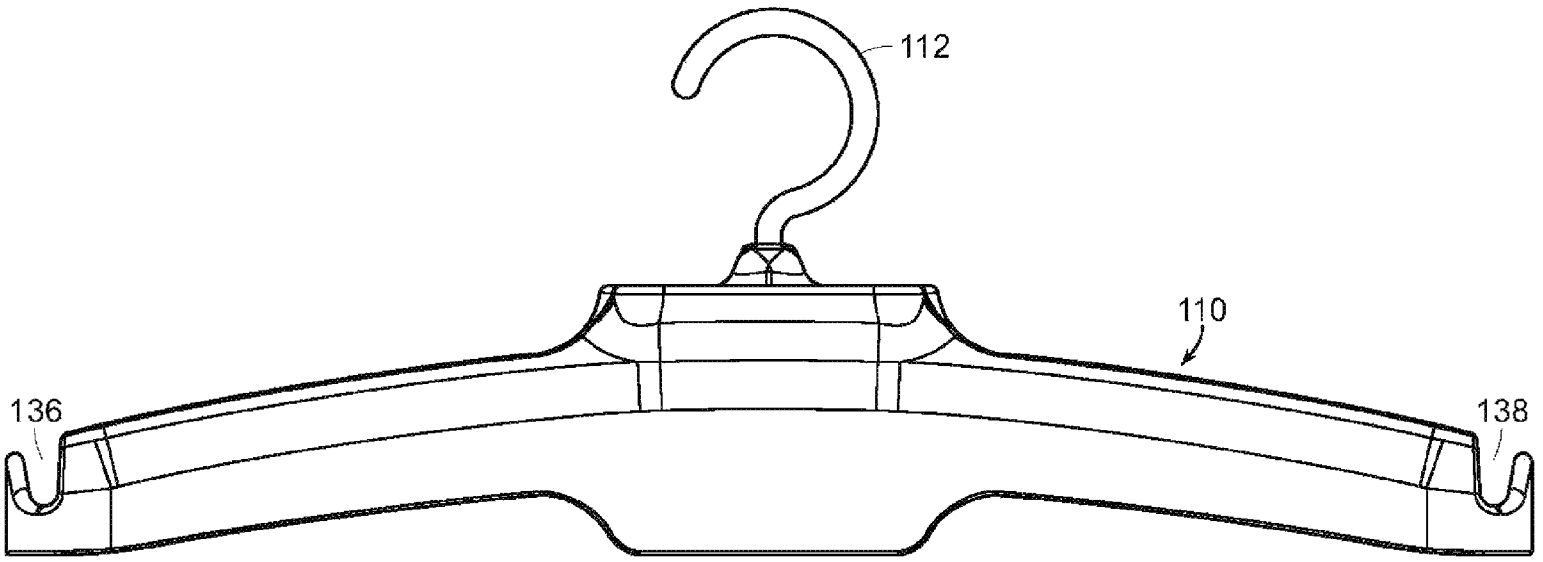
FIG. 3 is an elevation view of the hanger of FIG. 2.
Figure 4:
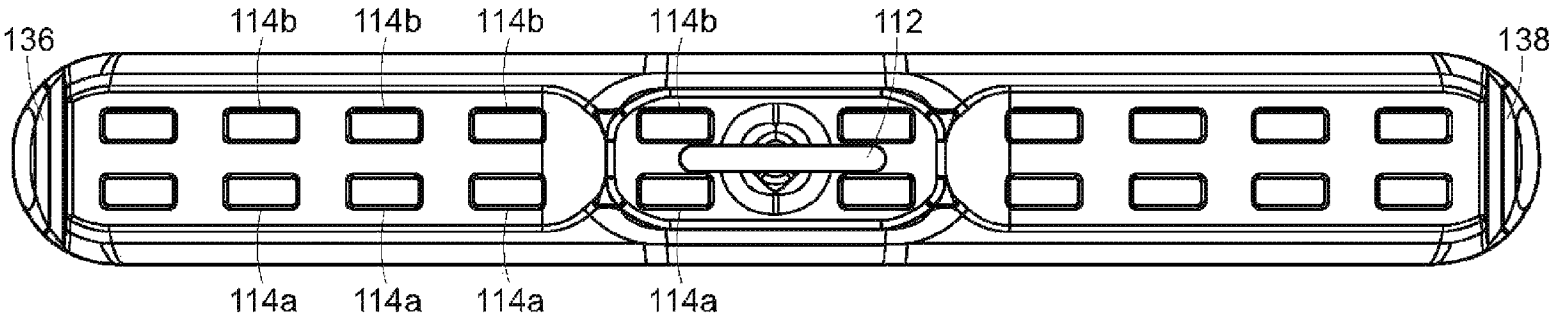
FIG. 4 is a top view of the hanger of FIG. 2.
Figure 5:
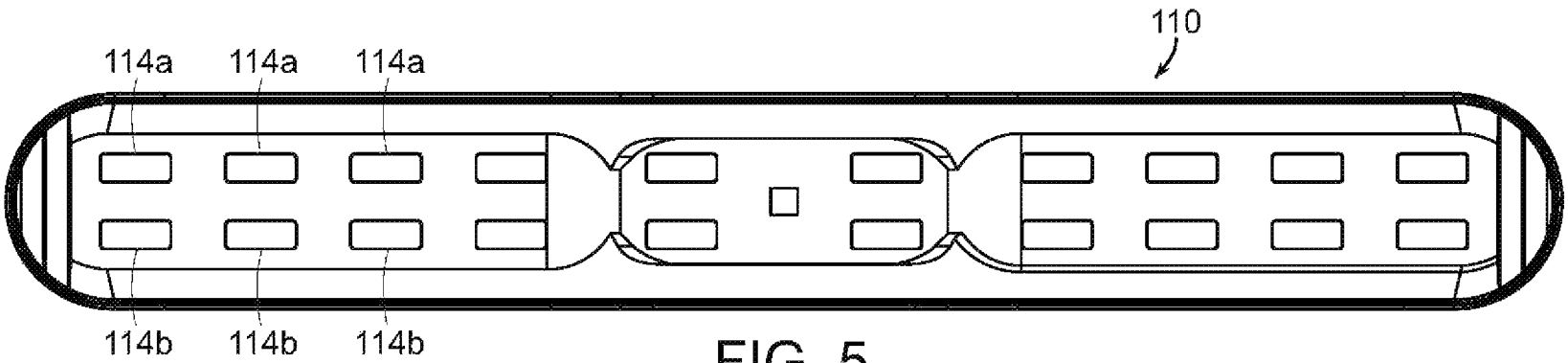
FIG. 5 is a bottom view of the hanger of FIG. 2.
Figure 6:
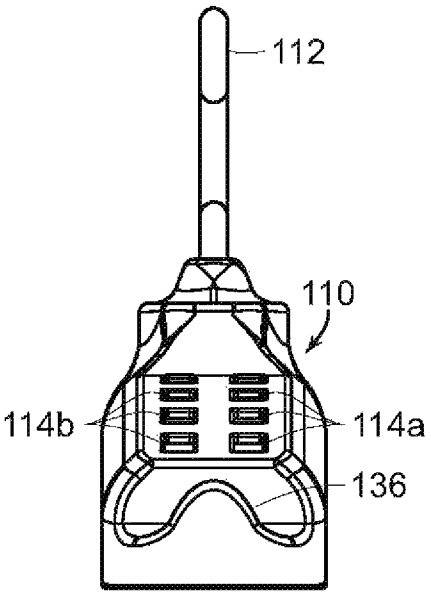
FIG. 6 is an end view of the hanger of FIG. 2.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a first embodiment hanger 9. The hanger comprises a horizontal member 10. A hook 12 is connected to the horizontal member. The horizontal member includes a plurality of horizontal apertures 14. A plurality of vertical members, in the form of straps 16 are supported by the horizontal member and include member fasteners 18 such as snaps, buttons, or hook and loop fastener. A vertical member adjusting clip 20 is incorporated into each vertical member.

The apertures comprise a plurality of long, narrow apertures positioned parallel to the ground plane and at equidistant intervals to one another. The vertical members are inserted through the apertures, folded over and attached via snap, button, or other fastening means to itself, thus securing the vertical member to the horizontal member. Preferably, the vertical member is fed through an adjusting clip to enable lengthening and shortening of the vertical member. The fasteners are secured to each vertical member to manually attach to the edges of the garment, protective gear, uniform pieces, and/or accessories.

The hook 12 connects to the apex 10*a* of the horizontal member 10, by a snap fit, adhesive, fastener or other known method. Advantageously, the hook can be attached to the horizontal member in a fashion, such as with a snap fit, that will allow 360 degree rotation of the hook with respect to the horizontal member. The vertical members 16 are permanently affixed to a member adjuster 20 and fed through the open slots of the member adjuster 20. Garment/gear attachment fasteners 22, such as spring clips, are positioned along the vertical members 16 towards the bottom. The entire vertical member 16 is fed through apertures 14 in the horizontal member, or likewise in another embodiment, around a cross bar and are then attached to themselves via fastener 18, thus securing the plurality of vertical members 16 to the horizontal member 10.

The adjuster 20 can be of the type known in the art of straps for backpacks, helmet chin straps and the like.

The horizontal member allows for the hanging of an upper body garment, upper body protective gear, and/or jersey while the fasteners secured to the adjustable vertical members accommodate hanging of lower body garments, arm/elbow protective gear, lower body protective gear, gloves, and accessories. Gloves/elbow pads/upper arm pads are attached to the fasteners secured to the first two vertical members on either side, and farthest from the center. Lower body garments and gear including but not limited to pants, shin guards, kneepads, etc. are hung via the fasteners attached to the vertical members hanging closer to the center of the horizontal member.

The invention is assembled and used by inserting the hook into the apex of the horizontal member; assembling the vertical members, adjusting the clips, and garment/gear fasteners; inserting the top end of a vertical member through an aperture in the horizontal member and fastening the vertical member to itself.

FIGS. 2-6 illustrate an alternate embodiment hanger 100. The hanger comprises a horizontal member 110. A hook 112 is connected to the horizontal member. The horizontal member includes a plurality of vertical apertures 114*a*, 114*b* arranged in side-by-side parallel pairs. A plurality of vertical members, in the form of straps 116, are supported by the horizontal member. A vertical member adjusting clip 120 is incorporated into each vertical member. Although only two straps 116 are shown it should be understood that each pair of apertures 114*a*, 114*b* (10 pairs shown) could be occupied by a strap 116.

The apertures 114*a*, 114*b* comprise a plurality of long, narrow apertures positioned vertical to the ground plane and spaced apart along the horizontal member 110. Each strap 116 can be inserted from below through an aperture 114*a*, folded over and inserted into an adjacent aperture 114*b*, pulled down and wrapped around a center bar 120*a* of a clip 120, forming a connection 121. The portion of the strap 116 below the aperture 114*a* can be inserted behind upper and lower bars 120*b*, 120*c* of the clip 120 and in front of the connection 121, pulled down and connected to a garment fastener 122. The strap is wrapped around a bar 122*a* of the garment fastener 122, folded over and attached to itself forming a connection 123. The connections 121, 123 can be formed by snap, button, hook and loop fastener, adhesive, sewing or other fastening means. By sliding the adjusting clip 120 up or down on the strap 116, the overall effective length L of the strap can be changed. The fasteners 122, such as spring clips, attach to the edges of the garment, protective gear, uniform pieces, and/or accessories.

The hook 112 connects to the apex 112*a* of the horizontal member 110, by a snap fit, adhesive, fastener or other known method. Advantageously, the hook can be attached to the horizontal member in a fashion, such as with a snap fit, that will allow 360 degree rotation of the hook with respect to the horizontal member.

The adjuster 120 can be of the type known in the art of straps for backpacks, helmet chin straps and the like.

The horizontal member 110 also includes end hooks 136, 138 that provide an additional hanging support for apparel or sports equipment.

The horizontal member 110 allows for the hanging of an upper body garment, upper body protective gear, and/or jersey while the fasteners secured to the adjustable vertical members accommodate hanging of lower body garments, arm/elbow protective gear, lower body protective gear, gloves, and accessories. Gloves/elbow pads/upper arm pads are attached to the fasteners secured to the first two vertical members on either side, and farthest from the center. Lower body garments and gear including but not limited to pants, shin guards, kneepads, etc. are hung via the fasteners attached to the vertical members hanging closer to the center of the horizontal member.

The horizontal member can be composed of plastic, wood, composite material, or other materials. The hook can be composed of metal, wood, plastic, composite materials, or other materials. The vertical members in the form of straps can be composed of cloth, nylon or other materials. The strap adjuster can be composed of plastic, wood, metal, composite material or other materials. The spring clip can be a heavy-duty plastic or metal spring clip.

Figure 7:
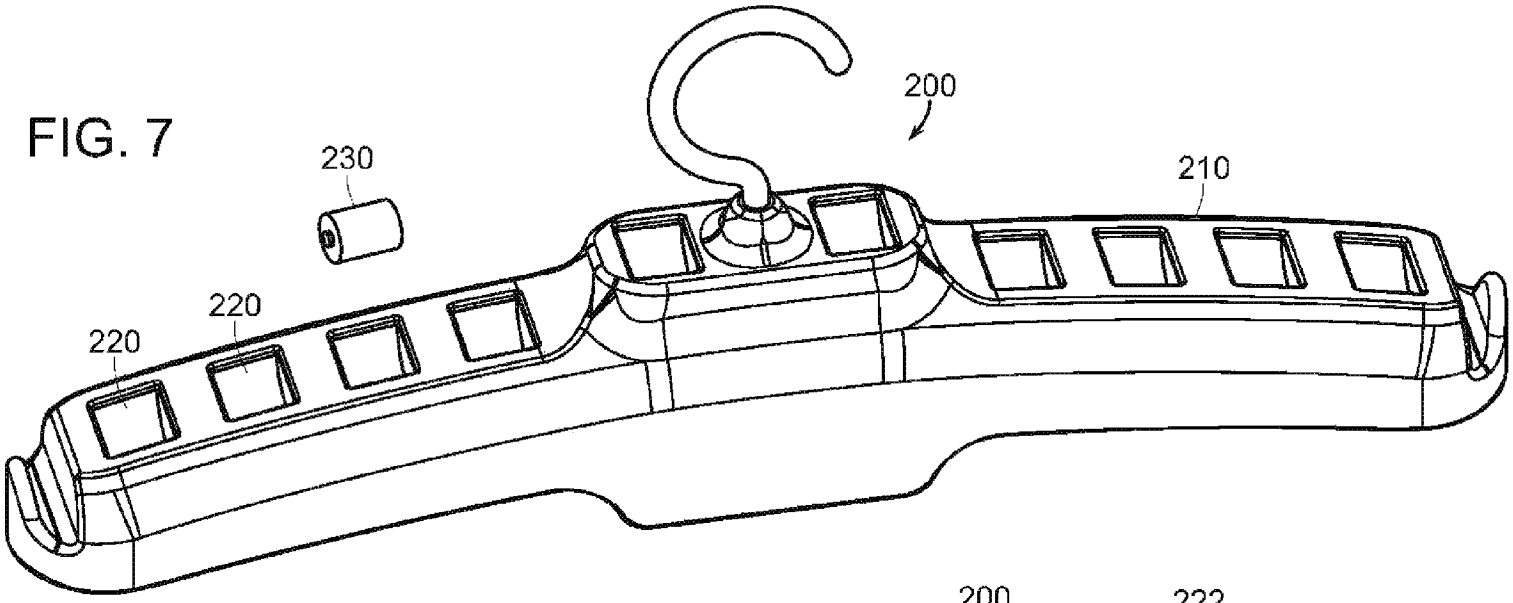
FIG. 7 is a perspective view of another embodiment hanger of the invention.
Figure 8:
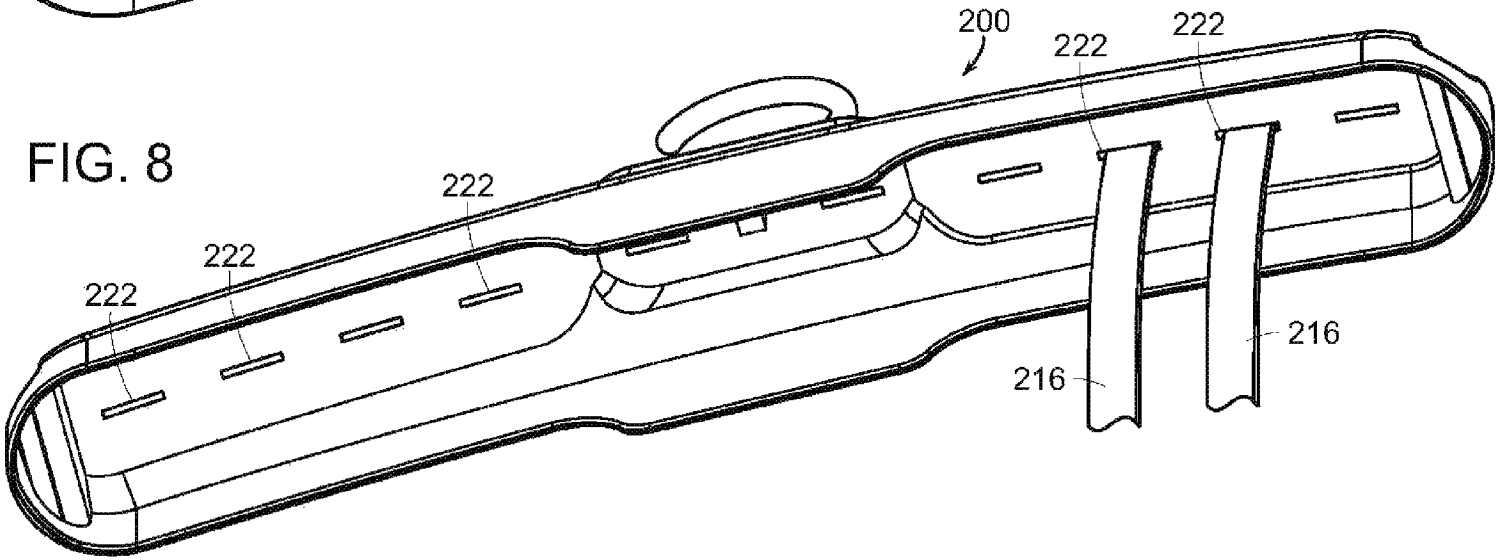
FIG. 8 is a perspective bottom view of the hanger of FIG. 7.
Figure 9:
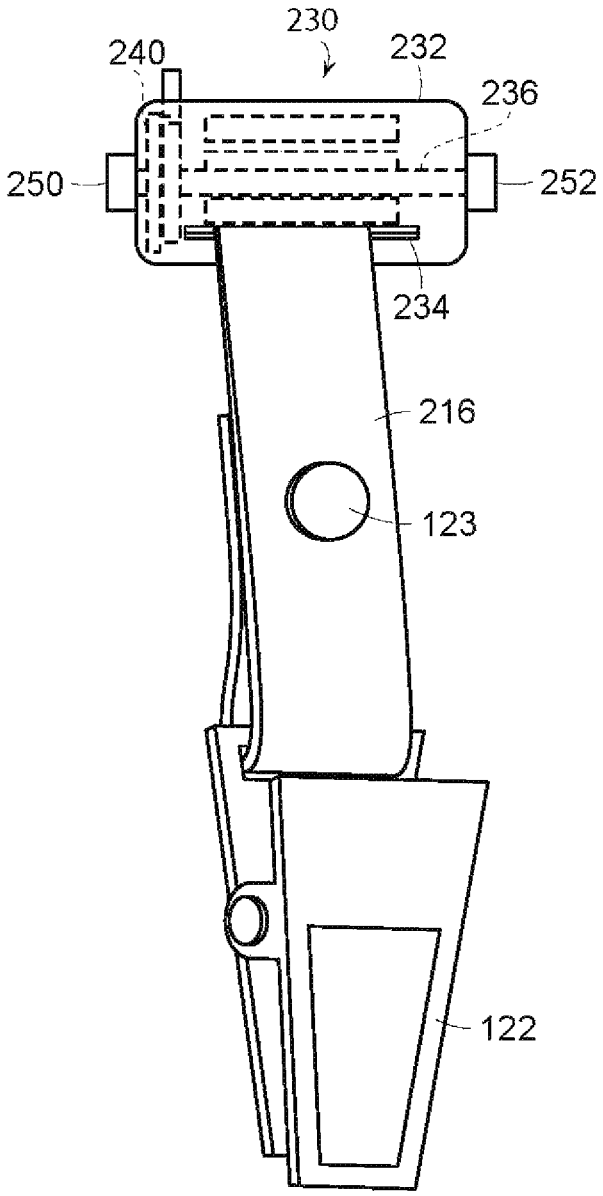
FIG. 9 is a perspective view of the a portion of the hanger of FIG. 7.

FIGS. 7-9 illustrate a further embodiment hanger 200 of the invention. The hanger 200 is identical to the hanger 100 except as described below. The hanger 200 includes a horizontal member 210 that includes compartments 220 formed into the horizontal member 210. The compartments 220 are shaped as rectangular open top boxes. The compartments include a slot 222 in the bottom thereof to allow a strap to pass therethrough. A cartridge 230 is provided to fit within each compartment 220.

FIG. 9 shows the cartridge 230, strap 216 and garment fastener 122 separate from the horizontal member 210 for clarity. The cartridge includes a housing 232 with a dispensing slot 234. A vertical member, in the form of a strap 216, is coiled on a spool 236 within the housing and a free end protrudes through the slot 234. The spool 236 is connected to a coiled torsion spring 240 which tends to wind up the strap 216 onto the spool 236. A sprocket 242 is provided fixed for rotation to the spool 236. A lock element 244 can be manually actuated to lock the sprocket with respect to the housing 232 once the desired length of strap is pulled from the cartridge. The lock will lock the length of the strap 216 that has been drawn out of the housing 232. The housing has protrusions 250, 252 that interlock with indentations (not shown) in the compartment 220 to keep the housing from rotating with respect to the compartment 220 as the strap is drawn out of the cartridge.

The mechanics of the cartridge and spool assembly can also be configured according to U.S. Pat. Nos. 5,294,029; 8,317,125; 6,912,975; 3,088,438; 3,477,410, herein incorporated by reference.

Although only two straps 216 are shown in FIG. 8, it should be understood that each compartment 220 shown in FIG. 7 (10 compartments 240 shown) could be occupied by a cartridge 230, and 10 straps provided for hanging pieces of garments or sports equipment.

In operation, the cartridge 230 is placed into the compartment 220 and the strap 216 is drawn from the housing slot 234 and down through the slot 222 by force as the spool 236 unwinds against the urging of the torsion spring 240. The strap 216 is folded over and engages the garment fastener 122 in the same fashion as in FIGS. 2-8. To suit the hanging of equipment, the straps 216 for the various cartridges can be drawn down to selected elevations with respect to the horizontal member 210 and then the locks are actuated to fix the lengths of the straps.

ALTERNATIVE EMBODIMENTS OF INVENTION

Other embodiments may include vertical members that are retractable into the horizontal member, vertical members that are fed around a horizontal cross-bar that is attached to the horizontal member, and a storage case surrounding the totality of the invention and the items that utilize its function.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A hanger for hanging pieces of sports gear, comprising:

a horizontal member having a center and left and right side portions on opposite sides of the center, each of the left and right side portions having a distal end spaced from the center, each of the left and right side portions having a plurality of apertures horizontally spaced-apart between the center and the respective distal end to hang pieces horizontally spaced apart, said horizontal member having an inverted U-shaped cross section with a top wall and opposing sidewalls, wherein the apertures are formed through the top wall;

a hook for supporting the horizontal member on external structure;

plural straps, each strap engaged to the horizontal member at an upper end of each respective strap at a selected one of the apertures; and each strap having a fastener at a lower end thereof for supporting a piece of sports gear.

2. The hanger according to claim 1, comprising a length adjuster on each strap to increase or decrease the distance between the horizontal member and the fastener.

3. The hanger according to claim 1, wherein the horizontal member comprises a hook portion on each opposite end thereof.

4. The hanger according to claim 1, wherein the horizontal member comprises a plurality of complementary apertures to form a plurality of aperture pairs with the apertures, each aperture pair comprising adjacent apertures and each strap is threaded through each of the adjacent apertures of the respective aperture pair.

5. The hanger according to claim 1, wherein each strap comprises a strap loop that threads through the respective aperture and captures a part of the horizontal member to attach the strap to the horizontal member.

6. The hanger according to claim 1, comprising a length adjuster on each strap to increase or decrease the distance between the horizontal member and the fastener, wherein the length adjuster comprises a spring loaded spool and the strap is coiled onto the spool.

7. The hanger according to claim 1, wherein the fastener comprises a spring clip.

8. A hanger for hanging multiple pieces, comprising:

a horizontal member having a center and left and right side portions on opposite sides of the center, each of the left and right side portions having a distal end spaced from the center, each of the left and right side portions having a plurality of apertures horizontally spaced-apart between the center and the respective distal end to hang pieces horizontally spaced apart, said horizontal member having an inverted U-shaped cross section with a top wall and opposing sidewalls, wherein the apertures are formed through the top wall;

a hook for supporting the horizontal member on external structure;

plural spaced-apart vertical members, each vertical member engaged to the horizontal member at an upper end thereof at a selected one of the apertures; and each vertical member having a fastener at a lower end thereof for engaging a piece.

9. The hanger according to claim 8, comprising a length adjuster on each vertical member to increase or decrease the distance between the horizontal member and the fastener.

10. The hanger according to claim 8, wherein the horizontal member comprises a hook portion on each opposite end thereof.

11. The hanger according to claim 8, wherein the horizontal member comprises a plurality of complementary apertures to form a plurality of aperture pairs with the apertures, each aperture pair comprising adjacent apertures and each vertical member is threaded through each of the adjacent apertures of the respective aperture pair.

12. The hanger according to claim 8, wherein each vertical member comprises a strap loop that threads through the respective aperture and captures a part of the horizontal member to attach the vertical member to the horizontal member.

13. The hanger according to claim 8, wherein the vertical members are horizontally spaced-apart along the horizontal member.

14. The hanger according to claim 8, wherein the fastener comprises strap loops closed by a surface faster.

15. The hanger according to claim 8, wherein the fastener comprises a spring clip.

16. The hanger according to claim 8, comprising a length adjuster on each vertical member to increase or decrease the distance between the horizontal member and the fastener, wherein the length adjuster comprises a spring loaded spool and the vertical member is coiled onto the spool.

* * * * *